US006067748A

United States Patent [19]

Williams

[11] Patent Number: 6,067,748

[45] Date of Patent: May 30, 2000

[54] MEMORIAL VASE

[76] Inventor: Gary Wayne Williams, 2411 Sharon Pl., Evansville, Ind. 47711

[21] Appl. No.: 09/192,749

[22] Filed: Nov. 16, 1998

[51] Int. Cl.[7] ..... A47G 7/02

[52] U.S. Cl. ..... 47/41.01; 47/41.11

[58] Field of Search ..... 47/41.01, 41.11, 47/41.14; 248/133, 312.1, 314

[56] References Cited

U.S. PATENT DOCUMENTS

| | | | |
|---|---|---|---|
| 1,077,027 | 10/1913 | Austin | 248/315 |
| 1,758,130 | 5/1930 | Shoemaker | 47/41.01 X |
| 2,104,256 | 1/1938 | Hambeck | 47/41.01 X |
| 3,141,577 | 7/1964 | Watson | 222/166 |
| 5,649,386 | 7/1997 | Rynberk | 47/41.14 |

*Primary Examiner*—Robert P. Swiatek
*Attorney, Agent, or Firm*—George H. Morgan

[57] ABSTRACT

A memorial vase comprises a container, a liner insert, a drain plug, a base, and a bolt and nut for securing the container to the base so the container can swivel with respect to the base. An adhesive gasket can be used to secure the base to a surface. An alternate embodiment uses a base that can be attached to a wall surface wherein the base has a shelf with an aperture for holding an alternate container with a flanged rim that is an assist for removal of the alternate container from the shelf.

1 Claim, 4 Drawing Sheets

MEMORIAL VASE

CROSS-REFERENCES TO RELATED APPLICATIONS

Not applicable.

STATEMENT AS TO RIGHTS TO INVENTIONS MADE UNDER FEDERALLY SPONSORED RESEARCH AND DEVELOPMENT

Not applicable.

BACKGROUND OF THE INVENTION

1. Field of the Invention:

The present invention relates to a vase that is attachable to a surface, such as, but not restricted to, of a crypt wall, a tombstone, or monument, especially on a sloped face of a tombstone or monument.

2. Background Information

Currently, most people, when decorating a grave, tend to leave flowers, either lying on the ground, or in loose containers at the site. After a few days, the cemetery maintenance people usually collect the flowers & vases and dispose of them.

There is a need for a container for flowers or ferns or other greenery that can be attached to a surface such as, but not restricted to, a crypt wall, tombstone, or monument. There is also a need for such a container that can be mounted on a sloped face of a tombstone or monument where the container is upright, even though a mounting surface is not parallel to the ground.

As will be seen from the subsequent description of the preferred embodiments of the present invention, these and other shortcomings of the prior art are overcome by the present invention.

SUMMARY OF THE INVENTION

The present invention, a memorial vase, in the preferred embodiment comprises a container, a base, a means of securing the container to the base, a tang with a clearance extending from the container which matches a groove and mounting clearances in the base so that the container is mountable into, can swivel with respect to the base, and can be secured to the base. The memorial vase further comprises an insert and a removable and reusable drain plug. The memorial vase can be attached to a surface by means of an adhesive gasket. As the container can swivel with respect to the base, the memorial vase is suitable for mounting on a sloped surface, even a vertical surface, with the container adjusted to an upright position.

DESCRIPTION OF THE PREFERRED EMBODIMENTS

Figure 1:
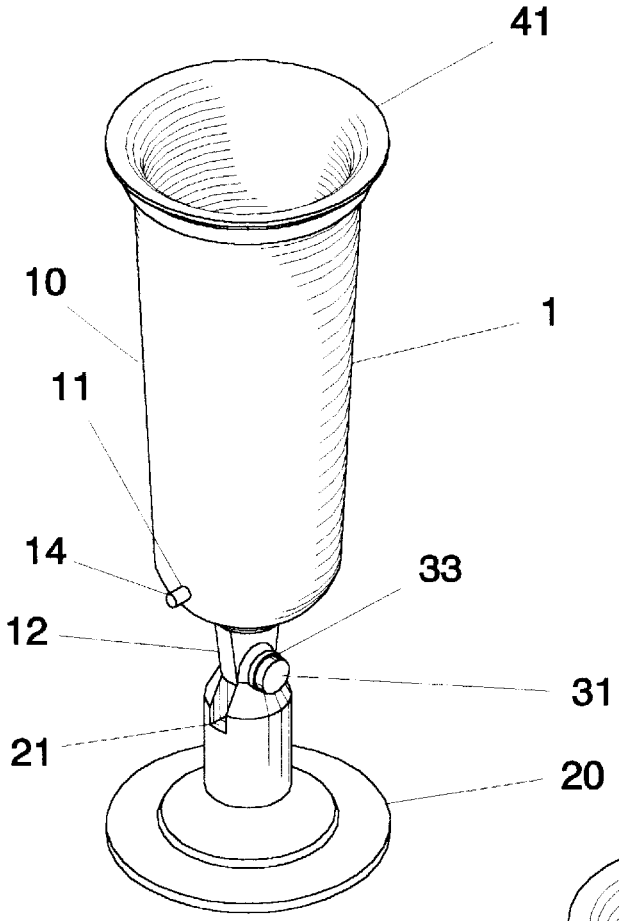
FIG. 1 is a view of the preferred embodiment of the present invention, a memorial vase, as it would stand on a surface.
Figure 2:
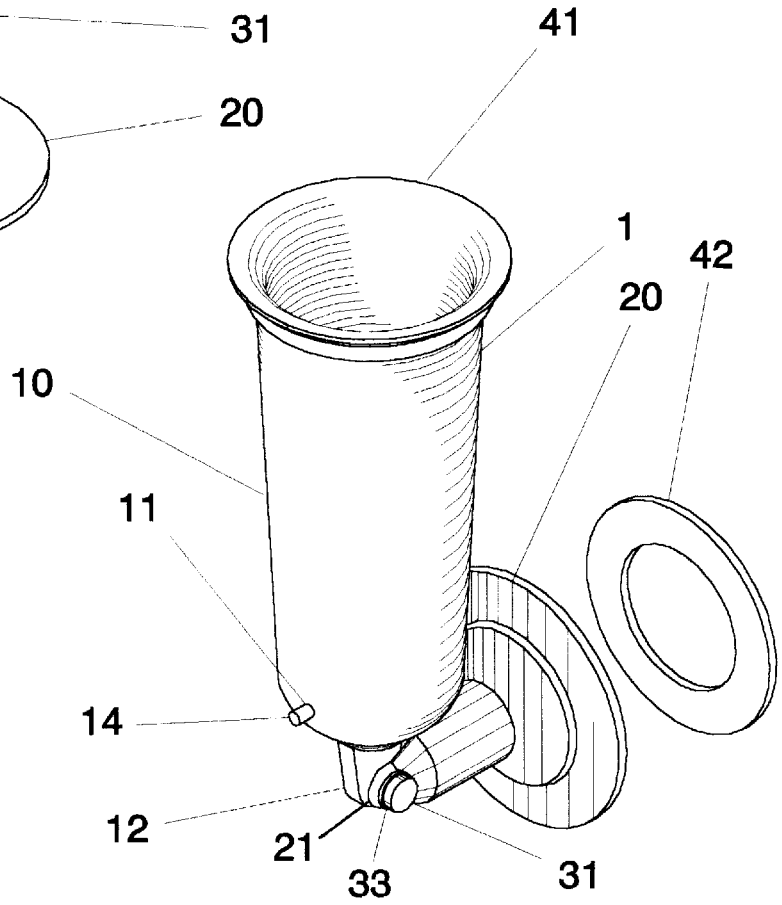
FIG. 2 is a view of the memorial vase as it could be attached to a wall surface.
Figure 3:
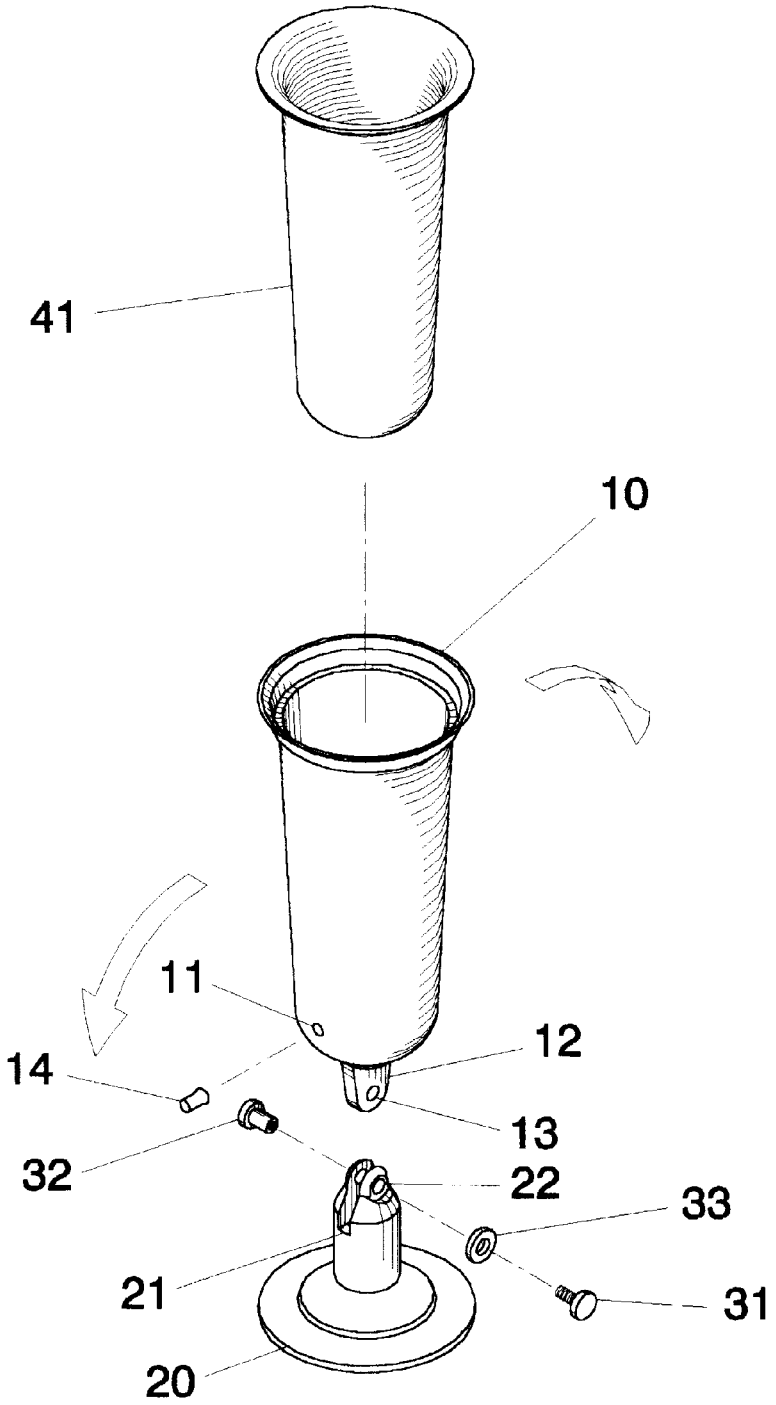
FIG. 3 is an exploded view of the memorial vase with arrows indicating directions of movement.

As shown in FIGS. 1, 2, and 3, the preferred embodiment of the present invention, a memorial vase 1, comprises a container 10, a liner insert 41, a drain plug 14, a base 20, a means of securing the container 10 to the base 20, and an adhesive gasket 42. The container 10 comprises a drain plug clearance 11, a mounting tang 12 with a clearance 13. The means of securing the container 10 to the base 20, in the preferred embodiment of the present invention comprise a bolt 31, a cap nut 32, and a washer 33. The base 20 has a mounting groove 21 and a mounting clearance 22 which permits the mounting of the container 10 into the base 20 where the container 10 can be secured to the base 20 with the the bolt 31, the cap nut 32, and the washer 33. The adhesive gasket 42 attaches to the base 20 and serves as a means of attachment of the base 20, with the container 10, to a surface.

When installing the memorial vase 1, the container 10 is swiveled as desired (i.e. set at a desired angle) with respect to the base 10, and then the bolt 31 is tightened on the cap nut to lock the container 10 at the desired angle. Arrows in FIG. 3 indicate directions of motion of the container 10 with respect to the base 20. An advantage of being able to swivel the container 10 with respect to the base 10 is that the base 10 can be attached to an inclined surface, as well as a vertical surface, with the container 10 upright in a vertical position so the container 10 can serve its intended function, to serve as a container for flowers, ferns, other greenery, a candle, or whatever so desired or appropriate for the occasion. Inclined plaques with varying degrees of slope are common memorials in cemetaries. The memorial vase 1, with the provision for swiveling and setting the container 10 with respect to the base, is can be installed on such plaques with the container 10 in a vertical position.

The liner insert 41 just sits in the container 10 and is removable. This is desirable for easy cleaning of the memorial vase 1.

The drain plug 14 permits draining of the memorial vase 1 in the event moisture accumulates. If the liner insert 41 is not used, the drain plug 14 is an even more desirable feature for conveniently draining water that may be used in conjunction with flowers placed or growing in the memorial vase 1. The drain plug 14 can be removed and reinstalled as required for periodic draining of said water.

Normally the adhesive gasket 42 is applied at time of memorial vase 1 manufacture, with an outside surface covered with a paper that can be removed when it is desired to attach the memorial vase 1 to a surface. While the adhesive gasket 42 is shown as a ring for the preferred embodiment, other shapes would serve the intended purpose, including a square piece, or a solid circular shape. The bottom of the base 20, to which the adhesive gasket 42 is placed can be a flat flush surface, or can contain a surface recessed so as to minimize exposure of the adhesive gasket 42 outer edge to the elements. The adhesive gasket 42 has adhesive on both sides so the gasket 42 will adhere to both the base 20 and a surface such as a wall surface enabling attachment of the base 20 to said surface. Such an adhesive gasket 42, also describable as a two sided pad with adhesive on both sides, is available from the Industrial Tape and Specialties Division of the Minnesota Mining and Manufacturing Co., 3M Center, St. Paul, Minn. 55144.

The materials of construction of the container 10 in the preferred embodiment of the present invention would be an injection molded plastic. However, as obvious to anyone skilled in the art, other materials including bronze, wood, marble, or ceramic would serve the same purpose. The liner, 41, in the preferred embodiment of the present invention, would be plastic, however, as obvious to anyone skilled in the art other materials might serve the same purpose, including ceramic. The base 20 would also be plastic in the preferred embodiment of the present invention, but again, as obvious to anyone skilled in the art, other materials might serve the same purpose.

Figure 4:
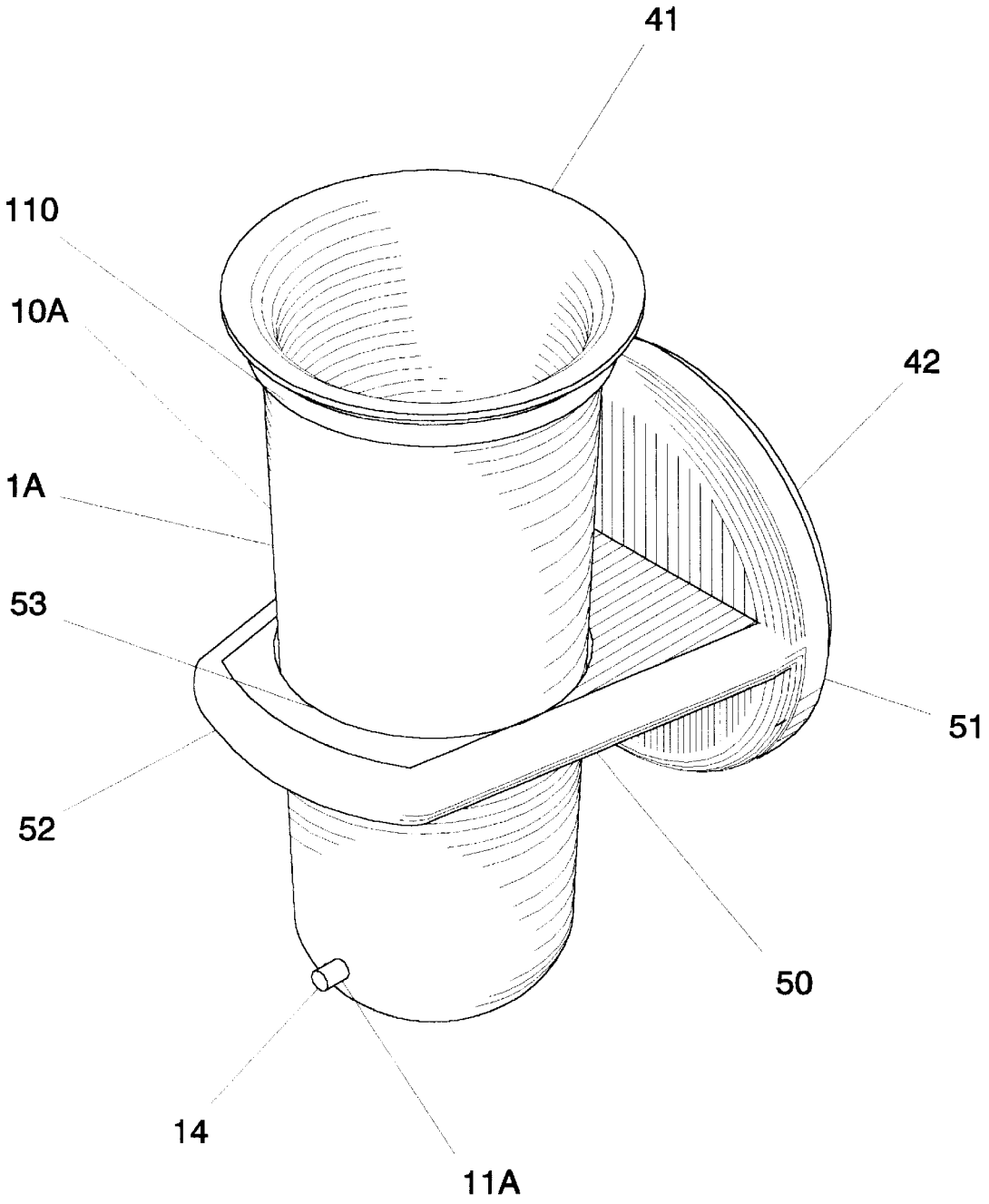
FIGS. 4 and 5 illustrate an alternate embodiment of the present invention.
Figure 5:
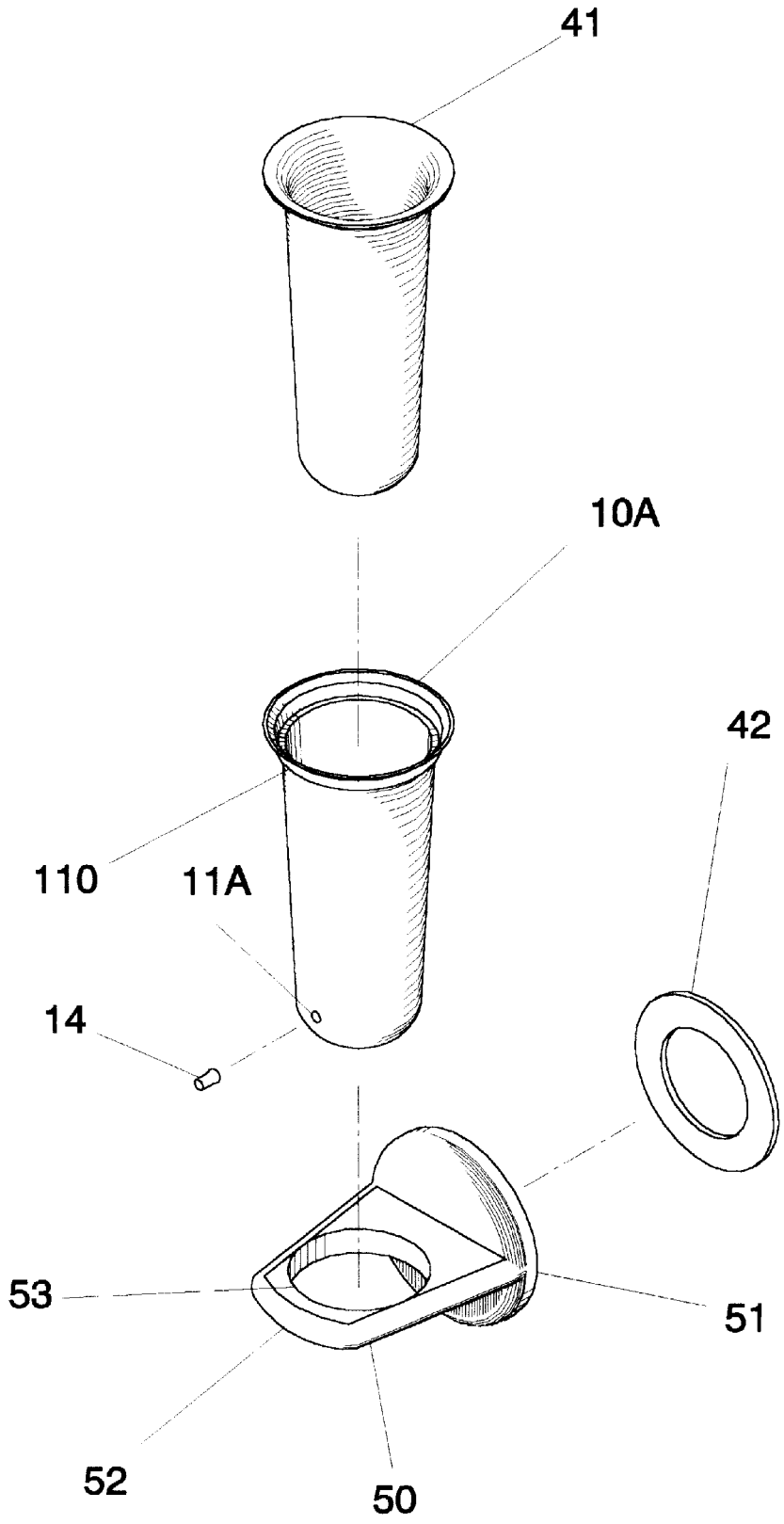

FIGS. 4 and 5 show an alternate embodiment of the present invention, an alternate memorial vase 1A comprising the liner 41, an alternate container 11A, the drain plug 14, a holder 50, and the adhesive gasket 42. The alternate container 11A further comprises an alternate drain plug clearance 11A and a flanged rim 110. The holder 50 comprises a shelf 52 with a container aperture 53, and a back 51. The shelf 52 projects from the back 51. As shown in FIG. 4, the alternate container 11A has a taper so it can be held in the container aperture 53. The back 51 of the holder 50 can be secured to a wall by means of the adhesive gasket 42, in the manner described for the base 20.

The flanged rim 110 serves a functional purpose, as an assist, in the event one wants to use an implement to remove the alternate container 11A from the holder 50, as might be desirable in the event the holder 50 with the alternate container 11A is mounted at an elevation beyond a person's normal reach.

In the preferred embodiment of the present invention, the preferred material of construction of the base 50 is plastic, however, as obvious to anyone skilled in the art, a number of materials will serve the same purpose, including wood, marble, ceramic, or metal.

Features and advantages of the preferred embodiment of the present invention include a convenient way to display flowers on memorials such as, but not restricted to, tombstones.

Although the description above contains many specificities, these should not be construed as limiting the scope of the invention but as merely providing illustrations of some of the presently preferred embodiments of the present invention.

For example, the invention is directed towards flowers. However, the invention would also serve as a convenient way to display ferns, greenery in general, and also candles.

Thus the scope of the invention should be determined by the appended claims and their legal equivalents, rather than by the examples given.

I claim:

1. A memorial vase comprising:

a) a base comprising a mounting groove and mounting clearances, b) a container comprising a mounting tang with a clearance, said mounting tang fitting into the mounting groove of the base, so the container can be mounted into the base, swiveled as desired, and then secured in position with respect to the base, c) a means of securing the container with respect to the base, said means comprising a nut and a bolt, d) a liner insert which inserts into the container, e) a means of attaching the base of the memorial vase to a surface, said means comprising an adhesive gasket which has adhesive on both sides so the adhesive gasket can stick to the base and to said surface, enabling the attachment of the base to said surface, and f) a drain plug in a clearance in said container.

* * * * *